US007775350B2

(12) United States Patent
Palamountain

(10) Patent No.: US 7,775,350 B2
(45) Date of Patent: Aug. 17, 2010

(54) SYSTEMS AND METHODS FOR IMPROVED BATHROOM TISSUE

(76) Inventor: Matthew Ross Palamountain, 4079 Happy Valley Rd., Lafayette, CA (US) 94549

( * ) Notice: Subject to any disclaimer, the term of this patent is extended or adjusted under 35 U.S.C. 154(b) by 68 days.

(21) Appl. No.: 12/016,983

(22) Filed: Jan. 18, 2008

(65) Prior Publication Data

US 2009/0184010 A1 Jul. 23, 2009

(51) Int. Cl.
*B65D 69/00* (2006.01)
*B65D 71/00* (2006.01)

(52) U.S. Cl. ..... 206/226; 206/225; 206/389; 206/409; 206/233; 221/33

(58) Field of Classification Search ..... 206/226, 206/229, 225, 389, 409, 233, 413; 222/192; 221/33, 199

See application file for complete search history.

(56) References Cited

U.S. PATENT DOCUMENTS 6,702,225 B2 3/2004 Newman et al.
6,899,250 B2 5/2005 FitzSimons et al.
7,040,502 B2 5/2006 Phelps et al.
7,293,738 B2 11/2007 Grebonval et al.
7,559,434 B2 * 7/2009 Masting ..... 221/34
2002/0162848 A1 * 11/2002 Na ..... 221/63
2004/0120988 A1 * 6/2004 Masting ..... 424/443

OTHER PUBLICATIONS

ISA/KR, PCT Written Opinion and International Search Report, Application No. PCT/US2009/030979, dated Jun. 17, 2009, 6 pages.

* cited by examiner

*Primary Examiner*—Ehud Gartenberg
*Assistant Examiner*—Blaine G Neway
(74) *Attorney, Agent, or Firm*—Kang Lim

(57) ABSTRACT

A bathroom tissue including a tissue roll core substantially cylindrical in shape. The tissue roll core includes a void for receiving a rod of the standard sized bathroom tissue roll dispenser. The tissue roll core may be substantially impermeable to moisture and include an aperture. A dry tissue roll is wound about the tissue roll core. An opening in the wound dry tissue roll extends to the aperture. A wet tissue roll is housed within the tissue roll core, and may be accessed through the opening and aperture. The wet tissue roll may rotate independently of the dry tissue roll. The wet tissue roll may be pre-moistened with any suitable solution including at least one of a saline solution, alcohol, amphoteric surfactants, humectants, thickeners and preservatives. The bathroom tissue roll includes a weight, or the void is off-center, for orientating the bathroom tissue roll such that the opening is accessible. Both wet and dry tissue roll may be perforated, and may include at least one of lotions, medications, perfume and coloring.

17 Claims, 9 Drawing Sheets

SYSTEMS AND METHODS FOR IMPROVED BATHROOM TISSUE

BACKGROUND OF THE INVENTION

This invention relates generally to bathroom tissue. Bathroom tissue is a modern necessity, which plays a crucial role in personal comfort and hygiene. More particularly, this invention relates to an improved bathroom tissue capable of dispensing both "wet" and dry towelettes for improved comfort and cleaning, thereby improving hygiene and sanitation. Such an improved bathroom tissue may also be of particular use for infant care purposes. Additionally, the improved bathroom tissue may also be helpful for use with recovering medical patients that are sore, or otherwise sensitive to cleaning.

Moreover, the improved bathroom tissue may be easily adapted to a wide variety of household and cleaning purposes. For example, such a system may be adapted for general household cleaning. In such an example, the wet tissues may include a general cleaner or disinfectant. In another embodiment, the roll may be adapted for window cleaning purposes, with the wet wipes including an ammonium bases solution for glass cleaning purposes and the dry roll, a paper towel type tissue. Other examples include tissue rolls designed for infant care, cosmetic clean up, acne care, or particularly medicated tissues for health care purposes.

Bathroom tissue, which differs in composition from facial tissue, is designed to deteriorate when wet in order to keep drain pipes clear. Some types of bathroom tissue are designed to decompose in septic tanks, which some other bathroom and facial tissues do not. Most septic tank manufacturers advise against using paper products that are non-septic tank safe. Different names are used for bathroom tissue in countries around the world, including "loo roll/paper", "toilet roll", "dunny roll/paper", "bog roll", "TP," or "bathroom/toilet paper".

Although paper had been known as a wrapping and padding material in China since the 2nd century BC, the first use of toilet paper in human history dates back to the 6th century AD, in early medieval China. However, it was not until 1857 that New Yorker Joseph C. Gayetty produced the first packaged bathroom tissue in the United States. The Scott Paper Company was the first company to manufacture tissue on a roll, specifically for the use of bathroom tissue.

Prior to the invent of bathroom tissue, people utilized an array of alternative materials for cleaning, including newsprint, paper catalogue pages, corn cobs, shells, sand, hayballs, grass, gompf stick, a sponge soaked in salt water, lace and hemp. Additionally, defecating in the river was very common. Each of these foregoing methods of cleaning oneself is considered unsanitary and unsavory when viewed through a modern lens.

Unfortunately, the modern use of traditional bathroom tissue is less hygienic than most people would presume. Typically washing with soap and water is required to eliminate bacteria and possible parasites. Due to time constraints, and the lack of appropriate facilities when traveling, it is often impracticable to wash entirely after utilizing the facilities. As such, a preferred system of bathroom tissue that is more hygienic, while retaining comfort, is desired.

It is therefore apparent that an urgent need exists for an improved device capable of providing for personal cleansing. The envisioned device includes wet and dry towelette dispensing capability.

SUMMARY OF THE INVENTION

To achieve the foregoing and in accordance with the present invention, a method and system of an improved bathroom tissue roll is provided. Bathroom tissue is a modern necessity, which plays a crucial role in personal comfort and hygiene. The present invention relates to an improved bathroom tissue capable of dispensing both "wet" and dry tissue towelettes for improved comfort and cleaning, thereby improving hygiene and sanitation. Such an improved bathroom tissue may also be of particular use for enhanced hygiene, for infant care purposes, and for use with recovering medical patients that are sore, or otherwise sensitive to cleaning.

While this application predominantly discloses a device in the context for bathroom usage, such a system may be easily adapted to a wide variety of household and cleaning purposes. For example, such a system may be adapted for general household cleaning. In such an example, the wet tissues may include a general cleaner or disinfectant. In another embodiment, the roll may be adapted for window cleaning purposes, with the wet wipes including an ammonium bases solution for glass cleaning purposes and the dry roll a paper towel type tissue. Other examples include tissue rolls designed for infant care, cosmetic clean up, acne care, or particularly medicated tissues for health care purposes.

A bathroom tissue roll may be useful in association with a standard sized bathroom tissue roll dispenser. The bathroom tissue roll includes a tissue roll core substantially cylindrical in shape. The tissue roll core includes a void for receiving a rod of the standard sized bathroom tissue roll dispenser. The tissue roll core includes an aperture. Also, the tissue roll core may be substantially impermeable to moisture. The tissue roll core may be made of disposable materials, or may be capable of being refilled.

A dry tissue roll is wound about the tissue roll core. An opening in the wound dry tissue roll extends to the aperture. The dry tissue roll may be perforated. Also, the dry tissue roll may include at least one of lotions, medications, perfume and coloring.

A wet tissue roll is housed within the tissue roll core. The wet tissue roll may be accessed through the opening and aperture. The wet tissue roll may rotate independently of the dry tissue roll. The wet tissue roll may be pre-moistened with a saline solution. The wet tissue roll may be perforated. Also, the wet tissue roll may include at least one of lotions, medications, perfume and coloring.

The opening may include a moisture barrier as to prevent mitigation of moisture from the wet tissue roll to the dry tissue roll. The opening may include a closure limiting moisture evaporation.

In some embodiments the bathroom tissue roll includes a weight for orientating the bathroom tissue roll such that the opening is accessible. In some other embodiments the void for receiving the rod of the standard sized bathroom tissue roll dispenser is off-center for orientating the bathroom tissue roll such that the opening is accessible.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, one or more embodiments will now be described, by way of example, with reference to the accompanying drawings, in which.

DETAILED DESCRIPTION OF THE INVENTION

The present invention will now be described in detail with reference to several embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention. The features and advantages of the present invention may be better understood with reference to the drawings and discussions that follow.

As previously mentioned, bathroom tissue is a modern necessity, which plays a crucial role in personal comfort and hygiene. The present invention relates to an improved bathroom tissue capable of dispensing both "wet" and dry tissue towelettes for improved comfort and cleaning, thereby improving hygiene and sanitation. Additionally, the improved bathroom tissue may be easily adapted to a wide variety of household and cleaning purposes, as previously noted.

Figure 1A:
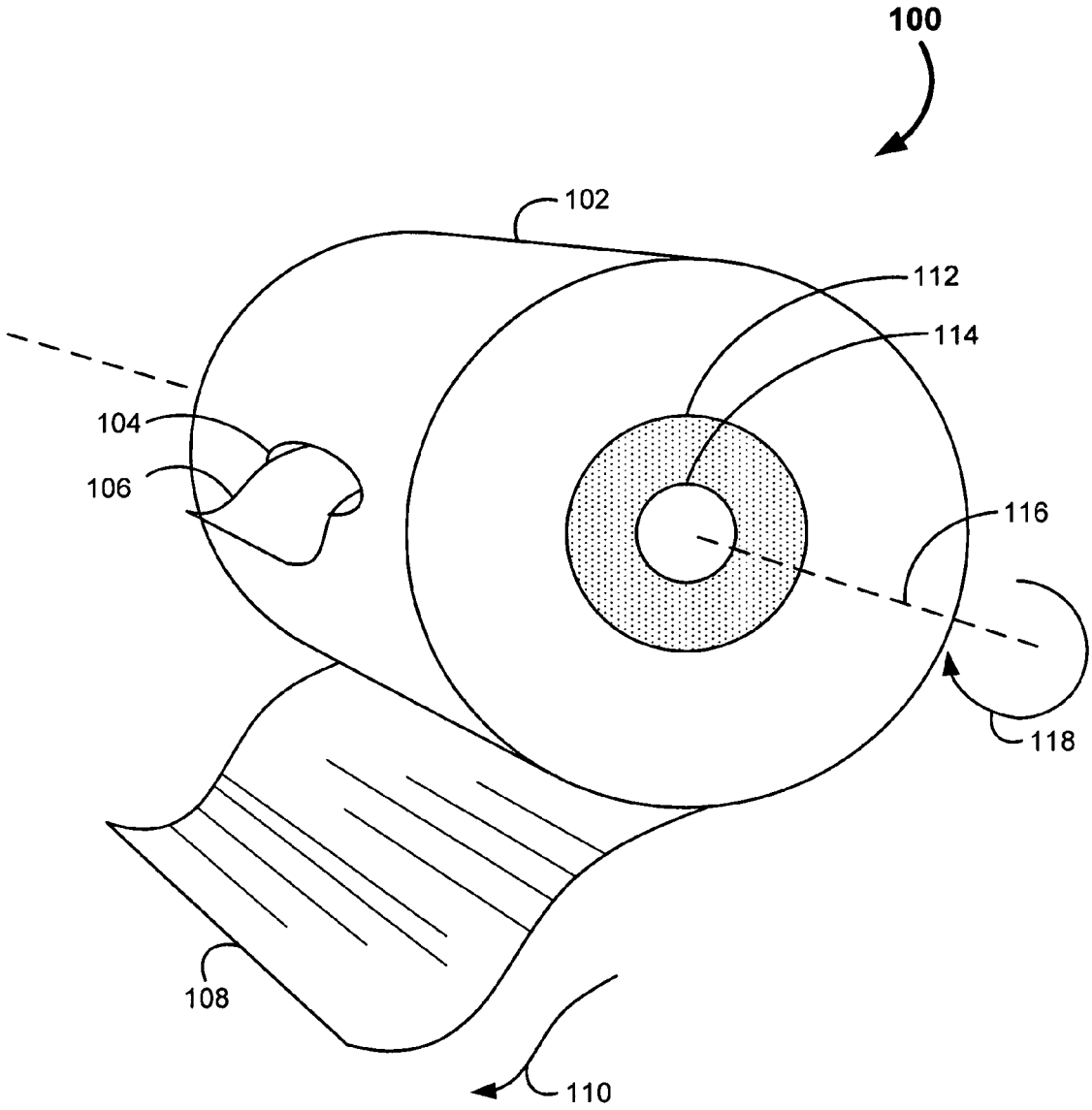
FIG. 1A shows a perspective illustration of an improved bathroom tissue in accordance with an embodiment of the present invention.

To facilitate discussion, FIG. 1A shows a perspective illustration of an Improved Bathroom Tissue Roll 100. The Dry Tissues 102 may be seen as surrounding the Tissue Roll Core 112. This bath tissue may be generated from cellulose products, however additional materials such as cotton, hemp and polymers may be included as is desired for absorption and texture. Typically, such tissue may include a pulp material, as well as a binding agent, as is well known by those skilled in the art. Moreover, this "dry" tissue may include lotions, coloring, perfumes and medications, as is well known by those skilled in the art. Additionally, such dry tissue may include any number of ply, typically ranging from single to three or more ply. The dry tissue may be perforated in "sheets" as to be easily torn at a desired length as it is unwound from the roll.

The Dry Tissues 102 may have the same dimensions of a standard roll of bathroom tissue. A Central Void 114 may pass through the Tissue Roll Core 112 along a Rotational Axis 116, thereby causing the Tissue Roll Core 112 to be annulated when viewed from its end. A rod from a standard bathroom tissue dispenser may pass through the Central Void 114 along the Rotational Axis 116 for mounting the Improved Bathroom Tissue Roll 100 in any location where standard bathroom tissue is used.

An important element of some embodiments of the invention is the appearance similar to standard bathroom tissue rolls, as well as the ability to readily fit into standard bathroom tissue dispensers. These features enable the improved bathroom tissue to be readily incorporated in any home, business or public restroom without cost prohibitive upgrades in dispensing equipment. Additionally, due to consumers' reluctance to change bathroom habits and general unease regarding personal hygiene, the common appearance of the improved bathroom tissue enables faster acceptance by relevant consumers.

A Rotational Indicia 118 indicates that the Improved Bathroom Tissue Roll 100 may be rotated along the Rotational Axis 116 due to the dispenser rod that fits through the Central Void 114. Likewise, Dispensing Direction 110 provides an exemplary illustration of the direction Tissue Sheets 108 may be unwound from the Dry Tissues 102 as the Improved Bathroom Tissue Roll 100 is rotated about the Rotational Axis 116 as indicated by the Rotational Indicia 118.

Moreover, the Wet Tissues 106 may be seen exiting the Dry Tissues 102 through an Opening 104 in this exemplary illustration. The Opening 104 shown here is elliptical, however a slit or round opening may also be used as is desired for aesthetics and functional concerns.

The "wet" tissues may also be generated from cellulose products, cotton, hemp and polymers as is desired for absorption and texture. Typically, such tissue may include a pulp material as well as a binding agent, as is well known by those skilled in the art.

The "wet" tissues may be pre-moistened using any suitable fluid. Fluids may be cleaning, conditioning or medicated in nature. Moreover, the particular formulation of the suitable solution may depend upon intended use of the tissue. For example, water may be the main ingredient and serves as a carrier and diluent for the other ingredients. For general hygiene, the wet tissues may be moistened by use of organic saline type solutions. For example, in some embodiments a 0.5% to 1.0% saline solution may be utilized to moisten the "wet" tissues. The wet tissues may also contain mild detergents mixed with moisturizing agents, fragrance, and preservatives.

The detergents that may be used include amphoteric surfactants, such as sodium diamphoacetate and coco phosphatidyl PG-dimonium. These chemicals do not strip the skin of natural oils and also decrease skin irritation potential. Mildness of the wet tissues may be a prime consideration given that the wipe solution may be in contact with delicate skin around the anus and genitals.

Of course Humectants such as propylene glycol (PEG) and glycerine may be added to prevent premature drying of the solution and contribute to skin moisturization. Additionally, oils may also be incorporated, such as mineral oil, lanolin, or silicones that help to soften skin.

Thickeners, such as cellulose derivatives like hydroxymethyl cellulose, control the viscosity of the finished product.

Other ingredients include preservatives, such as methyl and propyl paraben may also be included to ensure the solution does not support microbial growth. Fragrance may be added to increase consumer appeal and to help overcome body odors, but fragrance-free embodiments are also considered.

On the other hand, for general household cleaning, the wet tissues may be moistened using an antibacterial solution including organic compounds, such as alcohols and esters, or may utilize bleaches.

Moreover, the "wet" tissue may include lotions, coloring, vitamins and medications, as is well known by those skilled in the art. Due to the non-permeable nature of the core, the tissues may remain moist for prolonged periods.

The dry tissue may be wrapped around the core. The core may include an internal cavity capable of holding the "wet" tissues. Due to the moisture inside the core, durable materials may be utilized for the core, including but not limited to plastics, metals and reinforced cardboard types of materials. In some embodiments, the core may be manufactured for single use, and is intended to be discarded after the tissue is exhausted. In some alternate embodiments, the core may be manufactured to be durable enough to be repeatedly used through refill, or centralized recycling of the core.

The wet tissues may be rolled within the core around the shaft of the central void. The wet tissue may be perforated in "sheets" as to be easily torn at a desired length as it is unwound from the roll. In some alternate embodiments, the wet tissues may consist of individual folded sheets housed in the core in a way as to dispense the next sheet when the previous sheet is pulled from the core. Additionally, such wet tissue may include any number of ply, typically ranging from single to three or more ply.

In some embodiments, the wet and dry tissues may be enabled to independently unroll, thereby allowing for dispensing of either wet or dry tissues separately. Wet tissues may exit through a cutout in the dry tissue roll. In some alternate embodiments, wet tissues may dispense from the "top" of the roll core when the improved bathroom tissue roll is vertically mounted.

Some of the embodiments of the present bathroom tissue may be designed to deteriorate when wet in order to keep drain pipes clear. Also, in some embodiments, the "wet" towellettes may also be designed to deteriorate when placed in water of a certain molarity, or when exposed to particular additive. Likewise, the towelettes may be designed to decompose in septic tanks.

Such an improved bathroom tissue may also be of particular use for infant care purposes. Additionally, the improved bathroom tissue may also be helpful for use with recovering medical patients that are sore, or otherwise sensitive to cleaning. As previously mentioned, while this application predominantly discloses a device in the context for bathroom usage, such a system may be easily adapted to a wide variety of household and cleaning purposes. For example, such a system may be adapted for general household cleaning. In such an example, the wet tissues may include a general cleaner or disinfectant. In another embodiment, the roll may be adapted for window cleaning purposes, with the wet wipes including an ammonium bases solution for glass cleaning purposes and the dry roll a paper towel type tissue. Other examples include tissue rolls designed for infant care, cosmetic clean up, acne care, or particularly medicated tissues for health care purposes.

Figure 1B:
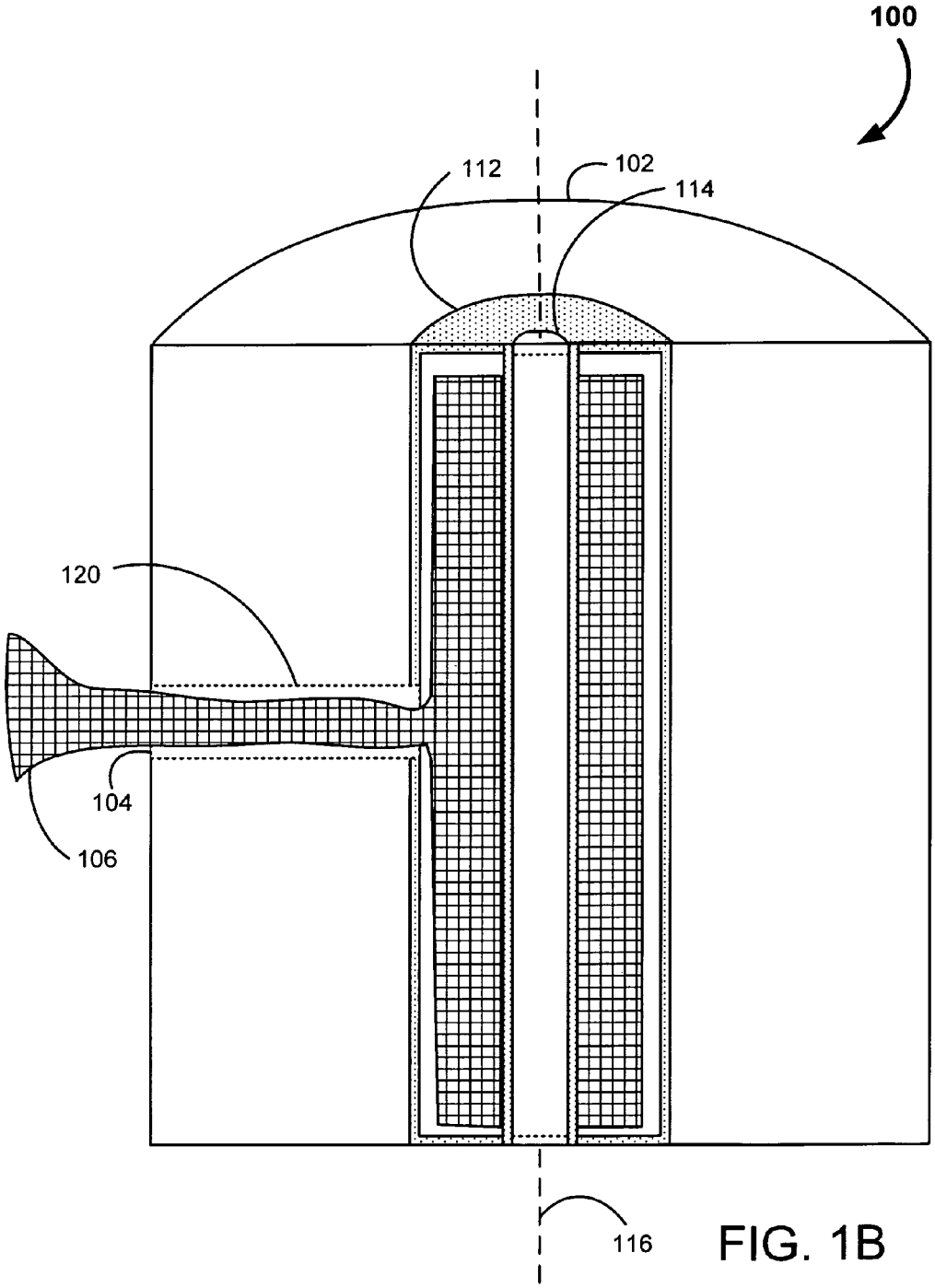
FIG. 1B shows a cut-away illustration of an improved bathroom tissue in accordance with an embodiment of the present invention.

FIG. 1B shows a cut-away illustration of the Improved Bathroom Tissue Roll 100. In this exemplary illustration, the Improved Bathroom Tissue Roll 100 has been vertically oriented for viewing ease. The Rotational Axis 116 may be seen extending vertically as well. Again, the Dry Tissues 102 may be seen as surrounding the Tissue Roll Core 112. The Central Void 114 is also shown as extending through the entire length of the Tissue Roll Core 112. Additionally the Tissue Roll Core 112 is seen to be hollow, or to otherwise include a cavity in which the Wet Tissues 106 may be rolled. In some embodiments, the wall of the Tissue Roll Core 112 around the Central Void 114 provides a shaft with which the Wet Tissues 106 may be wrapped about.

Of particular note is that the Wet Tissues 106 may travel from an opening in the Tissue Roll Core 112, through the Tissue Roll Core 112 and to the exterior through the Opening 104 by utilizing a Cutaway 120. In some embodiments, the Cutaway 120 may include a water barrier as to prevent the moisture from the Wet Tissues 106 from migrating into the Dry Tissues 102.

Figure 2A:
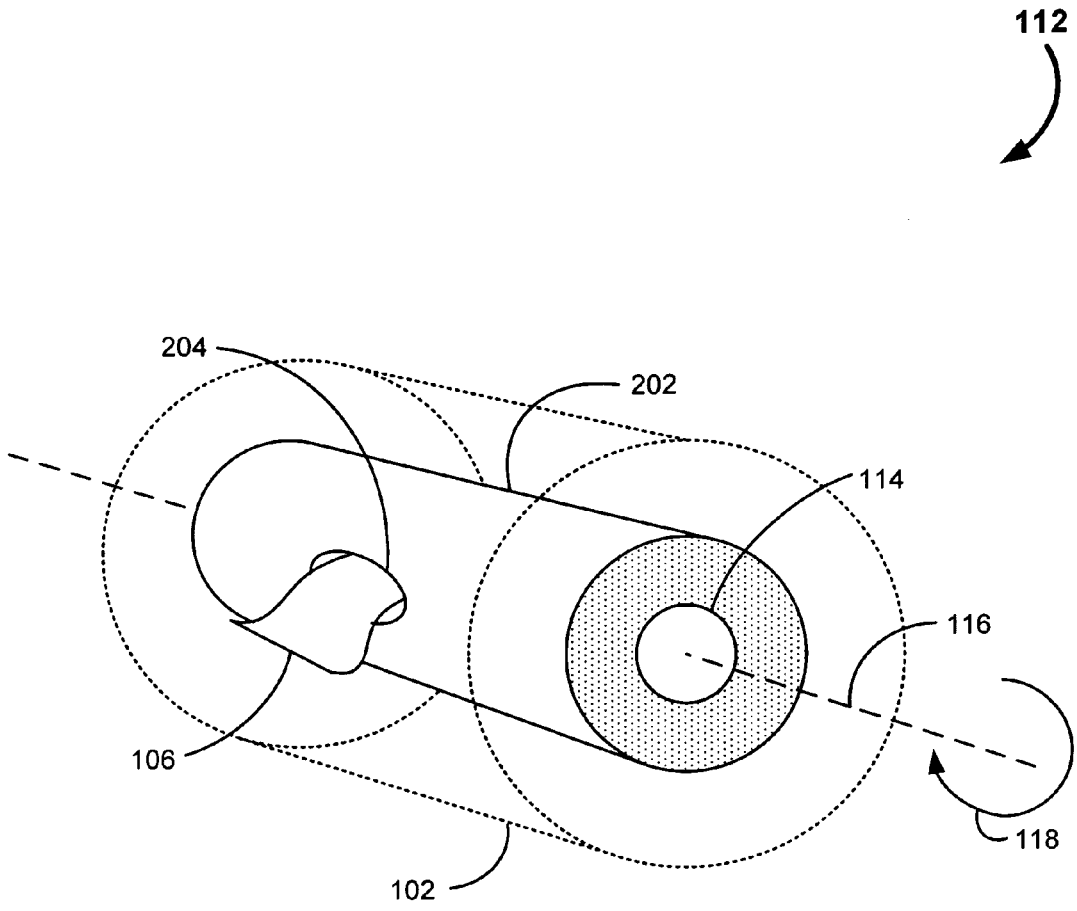
FIG. 2A shows a perspective illustration of a first embodiment of a core of the improved bathroom tissue of FIG. 1A.

FIG. 2A shows a perspective illustration of a first embodiment of the Tissue Roll Core 112. In this exemplary illustration, the Dry Tissues 102 are "see though" as illustrated by the dashed lines. This is intended to provide orientation of the Tissue Roll Core 112 within the Improved Bathroom Tissue Roll 100.

Again the Rotational Axis 116 may be seen, with the Rotational Indicia 118 indicating rotation of the Improved Bathroom Tissue Roll 100. The Central Void 114 passes centrally through the Tissue Roll Core 112. The Tissue Roll Core 112 includes a Core Shaft 202 which the Dry Tissues 102 wraps around. The Wet Tissues 106 passes out of the Core Shaft 202 through a Core Aperture 204.

Figure 2B:
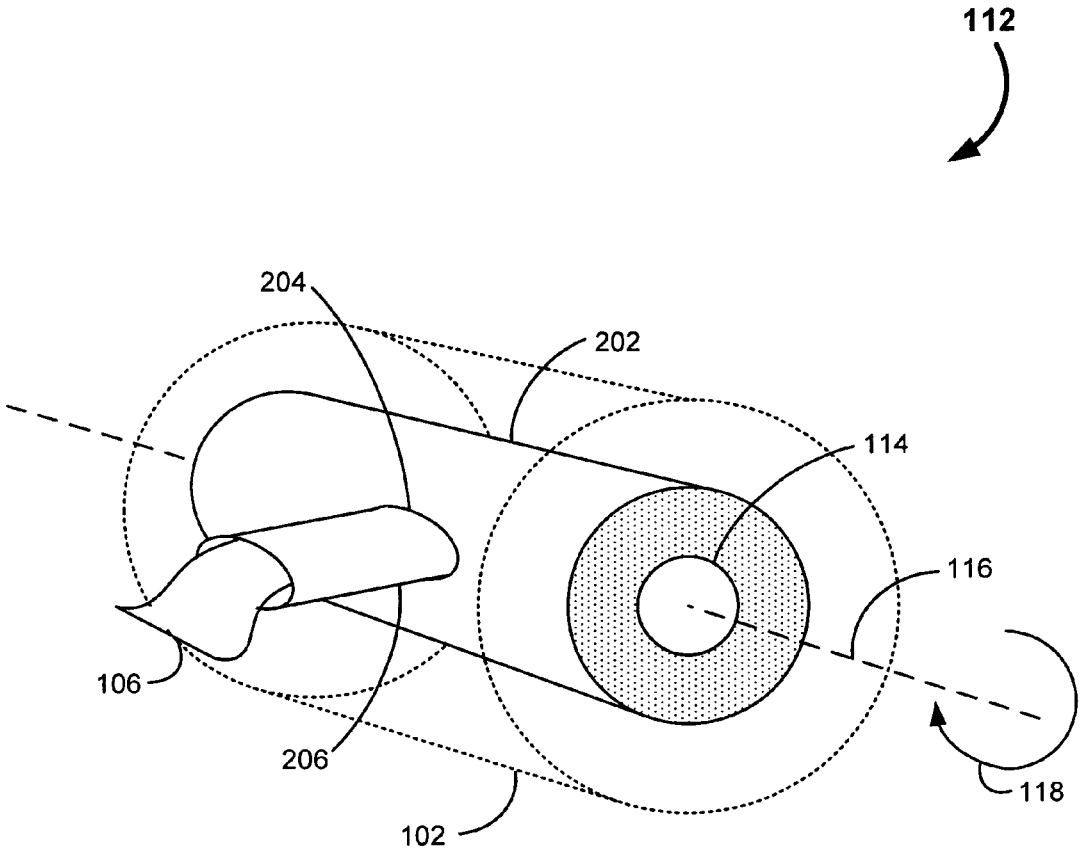
FIG. 2B shows a perspective illustration of a second embodiment of a core of the improved bathroom tissue of FIG. 1A.

FIG. 2B shows a perspective illustration of a second embodiment of the Tissue Roll Core 112. In this exemplary illustration, the Dry Tissues 102 are "see though" as illustrated by the dashed lines. This is intended to provide orientation of the Tissue Roll Core 112 within the Improved Bathroom Tissue Roll 100.

Again the Rotational Axis 116 may be seen, with the Rotational Indicia 118 indicating rotation of the Improved Bathroom Tissue Roll 100. The Central Void 114 passes centrally through the Tissue Roll Core 112. The Tissue Roll Core 112 includes a Core Shaft 202 which the Dry Tissues 102 wraps around. The Wet Tissues 106 passes out of the Core Shaft 202 through a Core Aperture 204 and into a Moisture Barrier 206. The Moisture Barrier 206 may extend through the Dry Tissues 102 to the Opening 104.

The Moisture Barrier 206 typically may be designed to be non-permeable to moisture as to prevent the Dry Tissues 102 from becoming moist through contact with the Wet Tissues 106. The Moisture Barrier 206 may be inseparable from the Core Shaft 202, or may be a separate component from the Core Shaft 202.

In some embodiments, the Moisture Barrier 206 may also have some closure at the opening to further restrict loss of moisture from the Wet Tissues 106, which is not shown. Such a closure may be self sealing, such as a spring mounted door, or other suitable sealing method.

Figure 2C:
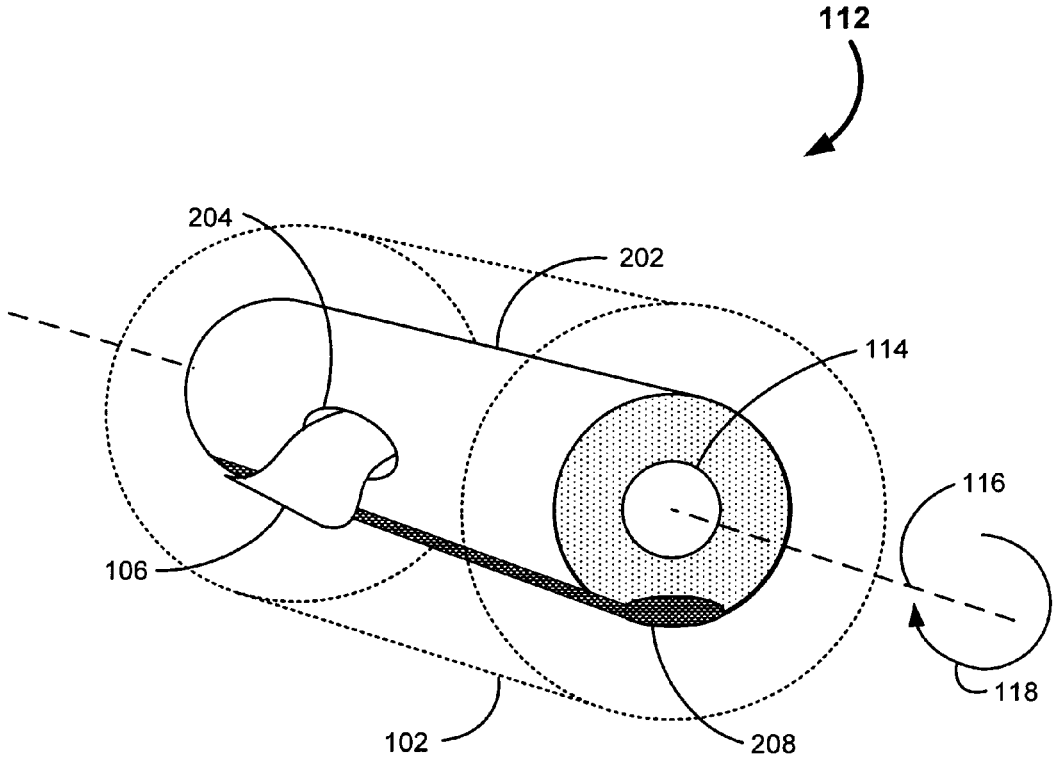
FIG. 2C shows a perspective illustration of a third embodiment of a core of the improved bathroom tissue of FIG. 1A.

FIG. 2C shows a perspective illustration of a third embodiment of the Tissue Roll Core 112. In this exemplary illustration the Dry Tissues 102 are "see though" as illustrated by the dashed lines. This is intended to provide orientation of the Tissue Roll Core 112 within the Improved Bathroom Tissue Roll 100.

Again the Rotational Axis 116 may be seen with the Rotational Indicia 118 indicating rotation of the Improved Bathroom Tissue Roll 100. The Central Void 114 passes centrally through the Tissue Roll Core 112. The Tissue Roll Core 112 includes a Core Shaft 202 which the Dry Tissues 102 wraps around. The Wet Tissues 106 passes out of the Core Shaft 202 through the Core Aperture 204.

Moreover, in this exemplary illustration, a Weight 208 may exist in the bottom of the Core Shaft 202. The Weight 208 may include any dense material including, but not limited to, metals, ceramics, water or sand. The Weight 208 may be compartmentalized within the Core Shaft 202 to prevent contamination to the Wet Tissues 106 from the Weight 208. The effect of the Weight 208 is to ensure the Improved Bathroom Tissue Roll 100 orients itself after rotation along the Rotational Indicia 118 such that the Wet Tissues 106 always faces outwards due to gravity effects. The benefit of the inclusion for the Weight 208 is thus to ensure ease of use by making the Wet Tissues 106 accessible.

Figure 2D:
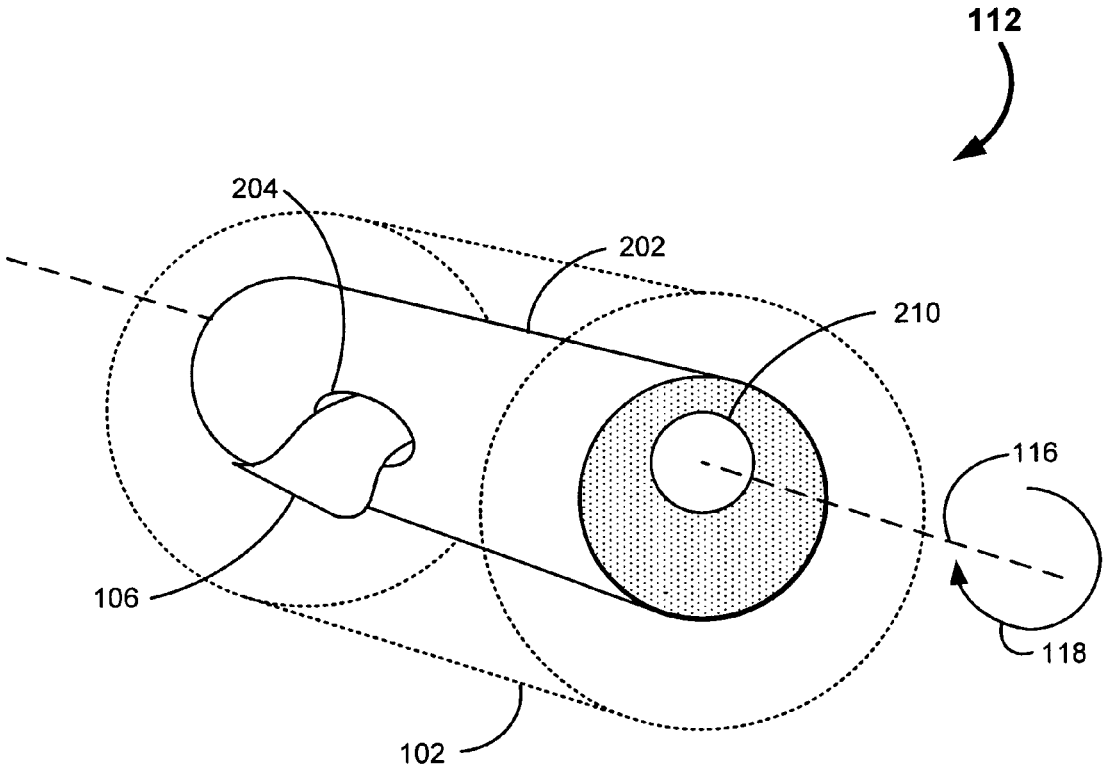
FIG. 2D shows a perspective illustration of a fourth embodiment of a core of the improved bathroom tissue of FIG. 1A.

FIG. 2D shows a perspective illustration of a fourth embodiment of the Tissue Roll Core 112. In this exemplary illustration, the Dry Tissues 102 are "see though" as illustrated by the dashed lines. This is intended to provide orientation of the Tissue Roll Core 112 within the Improved Bathroom Tissue Roll 100.

Again the Rotational Axis 116 may be seen with the Rotational Indicia 118 indicating rotation of the Improved Bathroom Tissue Roll 100. The Tissue Roll Core 112 includes a Core Shaft 202 which the Dry Tissues 102 wraps around. The Wet Tissues 106 passes out of the Core Shaft 202 through a Core Aperture 204.

Unlike previous embodiments, however, an Off-center Void 210 passes through the Tissue Roll Core 112 above the center. The off-center orientation of the Off-center Void 210 again ensures that the Improved Bathroom Tissue Roll 100 orients itself after rotation along the Rotational Indicia 118 such that the Wet Tissues 106 always faces outwards due to gravity effects. The benefit of the inclusion for the Off-center Void 210 is thus to ensure ease of use by making the Wet Tissues 106 accessible.

It should be noted that the embodiments of FIGS. 2A to 2D illustrate specific components, of which one skilled in the art may combine as is desirous. For example, the Tissue Roll Core 112 may include the Moisture Barrier 206 of FIG. 2B with the off-center orientation of the Off-center Void 210 of FIG. 2D.

Figure 3A:
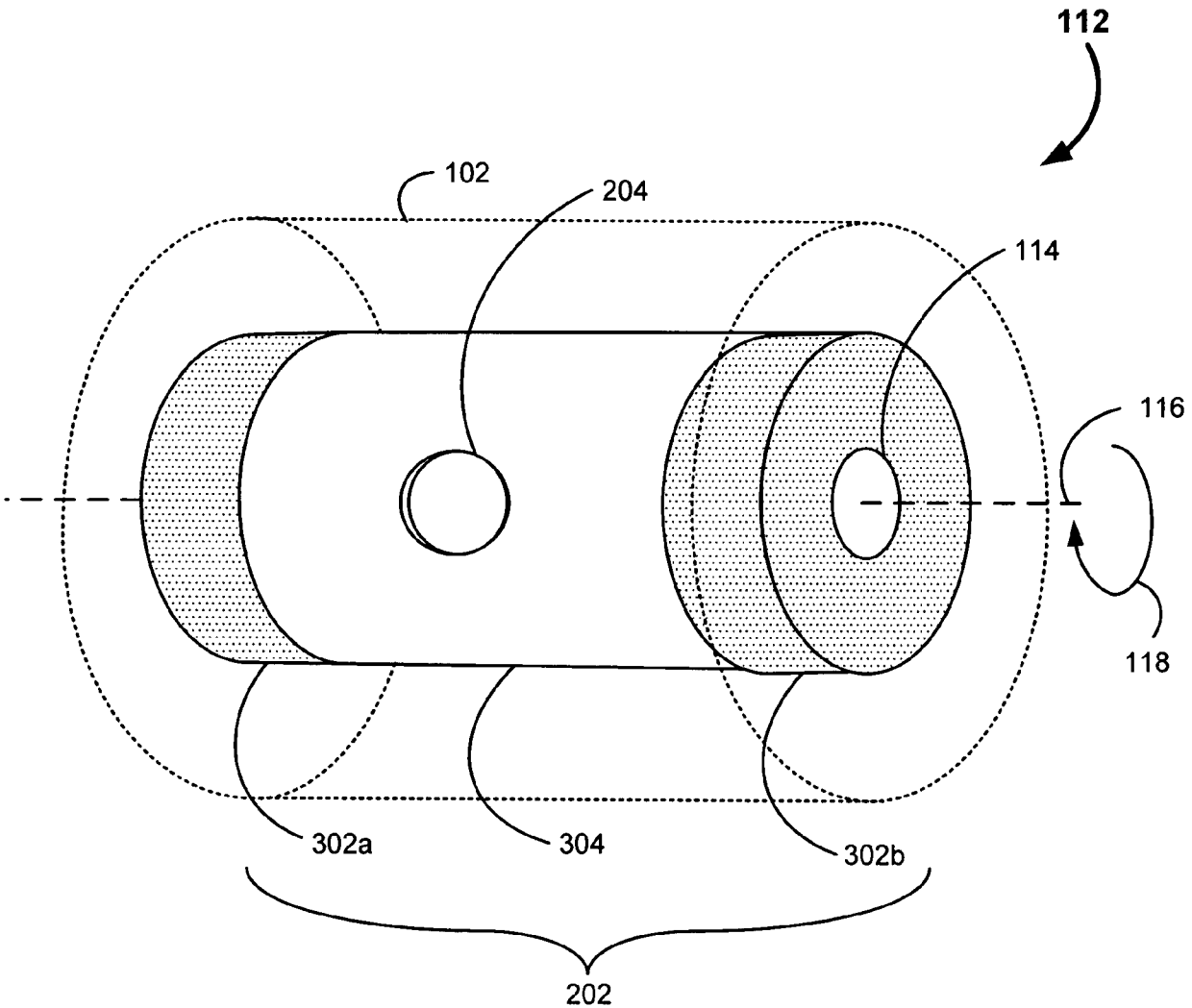
FIG. 3A shows a detailed illustration of a first embodiment of a core of the improved bathroom tissue of FIG. 1A.

FIG. 3A shows a detailed illustration of a first embodiment of the Tissue Roll Core 112. In this exemplary illustration, the Dry Tissues 102 are "see though" as illustrated by the dashed lines. This is intended to provide orientation of the Tissue Roll Core 112 within the Improved Bathroom Tissue Roll 100.

Again the Rotational Axis 116 may be seen with the Rotational Indicia 118 indicating rotation of the Improved Bathroom Tissue Roll 100. The Tissue Roll Core 112 includes a Core Shaft 202 which is comprised of three sections: End-Caps 302*a* and 302*b* respectively, and the Middle Housing 304. The Dry Tissues 102 wraps around the Core Shaft 202. The Wet Tissues 106 passes out of the Middle Housing 304 through a Core Aperture 204. In this example the End-Caps 302*a* and 302*b* may be joined to the Middle Housing 304 permanently with welding, glue or pressure sealing.

Alternatively, in some embodiments, the End-Caps 302*a* and 302*b* may be joined to the Middle Housing 304 in a manner where they may be sealed and opened at will. Threading, clipping with use of a gasket, or other method may be utilized to couple the End-Caps 302*a* and 302*b* to the Middle Housing 304. These embodiments may be of particular use when the Tissue Roll Core 112 is intended to be refillable, rather than disposable.

Again, it may be seen that a Central Void 114 passes through the Tissue Roll Core 112. Thus, a dispensing rod may be placed though the Central Void 114 for mounting on a dispenser.

Figure 3B:
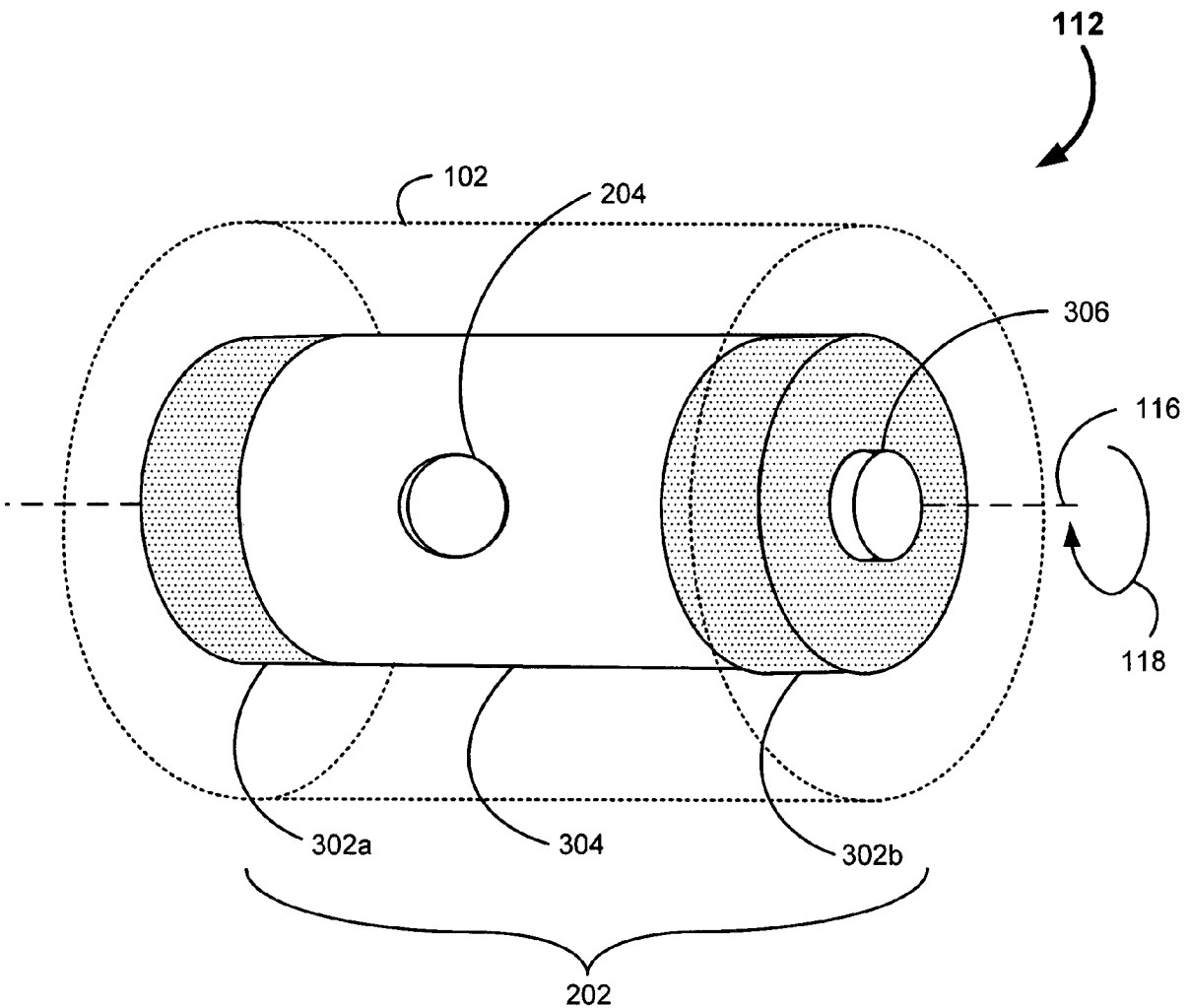
FIG. 3B shows a detailed illustration of a second embodiment of a core of the improved bathroom tissue of FIG. 1A.

FIG. 3B shows a detailed illustration of a second embodiment of the Tissue Roll Core 112. In this exemplary illustration, the Dry Tissues 102 are "see though" as illustrated by the dashed lines. This is intended to provide orientation of the Tissue Roll Core 112 within the Improved Bathroom Tissue Roll 100.

Again the Rotational Axis 116 may be seen with the Rotational Indicia 118 indicating rotation of the Improved Bathroom Tissue Roll 100. The Tissue Roll Core 112 includes a Core Shaft 202 which is comprised of three sections: End-Caps 302*a* and 302*b* respectively and the Middle Housing 304. The Dry Tissues 102 wraps around the Core Shaft 202. The Wet Tissues 106 passes out of the Middle Housing 304 through a Core Aperture 204. In this example the End-Caps 302*a* and 302*b* may be joined to the Middle Housing 304 permanently, or in a manner where they may be sealed and opened at will.

This exemplary embodiment includes a Mounting Protrusion 306 in lieu of the Central Void 114. The usage of the Mounting Protrusion 306 results in an expansion of the cavity within the Tissue Roll Core 112. Thus, additional Wet Tissues 106 may be included in the Improved Bathroom Tissue Roll 100 since the hollow of the Tissue Roll Core 112 has greater capacity. The Mounting Protrusion 306 may be configured as to fit as many standard dispensers as possible. Alternatively, in some embodiments, the Mounting Protrusion 306 may be configured to join with only particular dispenser units.

It should be also noted that the embodiments of FIGS. 2A to 2D illustrate specific components, of which one skilled in the art may combine as is desirous with either of the embodiments shown in FIG. 3A and FIG. 3B.

Figure 4:
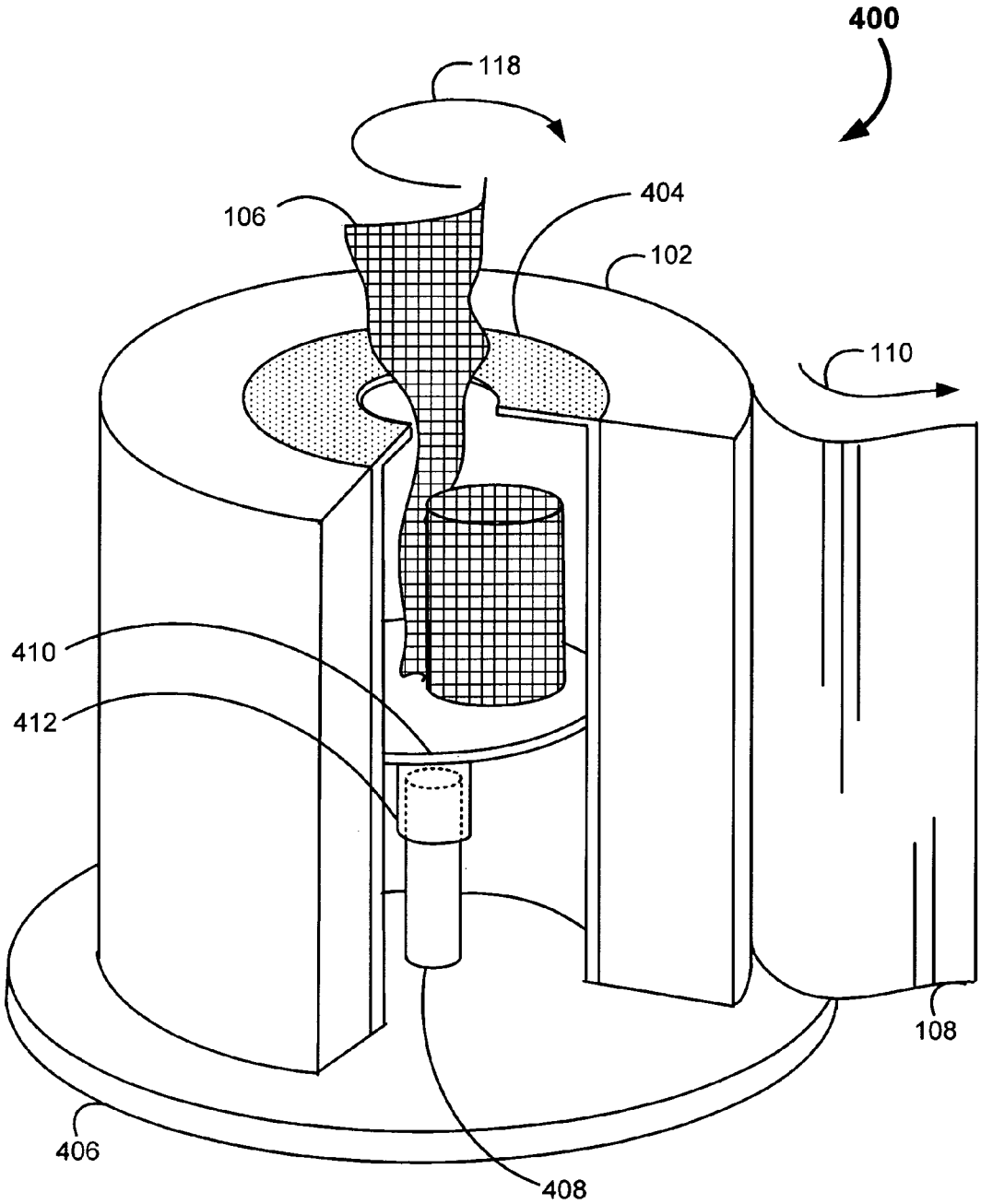
FIG. 4 shows an illustration of a vertically dispensing improved bathroom tissue with holder in accordance with an embodiment of the present invention.

FIG. 4 shows an illustration of a vertically dispensing improved bathroom tissue with holder, shown generally at 400. The exemplary illustration includes a cutaway view. The Dry Tissues 102 may be seen vertically mounted and capable of rotation about the Rotational Indicia 118. Additionally the Tissue Sheets 108 may be seen as dispensing along the Dispensing Direction 110. A Vertical Core 404 may also be seen which includes an opening on the top portion enabling access to the Wet Tissues 106. This design enables access to the Wet Tissues 106 without compromising the Dry Tissues 102.

This embodiment of the improved bathroom tissue may be mounted on a dispenser including a Base 406 and a Stem 408. The Stem 408 may extend into and couple with a Socket 412. The Socket 412 couples to a Cavity Floor 410. The Cavity Floor 410 may be integrated into the Vertical Core 404 to provide an enclosure for the roll of the Wet Tissues 106.

While this invention has been described in terms of several preferred embodiments, there are alterations, modifications, permutations, and substitute equivalents, which fall within the scope of this invention. For example, wherein the disclosed methods and systems have been illustrated for bathroom tissue, these systems and methods could just as easily be utilized for paper towel type products. In such embodiments the wet towelettes may include chlorine, ethanol or any other suitable antibacterial agent. In this way, dry paper towel and "bleach wipe" style products may be made singularly accessible for any household cleaning need.

It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A cleaning roll comprising:

a roll core substantially cylindrical in shape, wherein the roll core includes two recesses at opposing ends of the roll core, and wherein the roll core includes an aperture located on the cylindrical side wall of the roll core;

a dry paper roll wound about the roll core, wherein the wound dry paper roll includes an opening that extends to the aperture, wherein the opening and the aperture are in co-alignment; and wet towelettes housed within the roll core, wherein the wet towelettes may be accessed through the opening and aperture, and wherein the wet towelettes may be dispensed independently of the dry paper roll.

2. The cleaning roll of claim 1, wherein the cleaning roll is a bathroom tissue roll, and wherein a void extends between the recesses for receiving a rod of a standard sized bathroom tissue roll dispenser.

3. The cleaning roll of claim 1, wherein the wet towelettes are pre-moistened with a saline solution, and wherein the opening includes a moisture barrier configured to prevent mitigation of moisture from the wet towelettes to the dry paper roll.

4. The cleaning roll of claim 3, wherein the opening includes a closure limiting moisture evaporation.

5. The cleaning roll of claim 4, wherein the closure limiting moisture evaporation is self sealing.

6. The cleaning roll of claim 1, wherein the dry paper roll is perforated.

7. The cleaning roll of claim 1, wherein the wet towelettes are a wet tissue roll.

8. The cleaning roll of claim 7, wherein the wet tissue roll is perforated.

9. The cleaning roll of claim 8, wherein the wet tissue roll independently rotates within the roll core.

10. The cleaning roll of claim 1, wherein the wet towelettes are folded within the roll core in such a way as to dispense a second wet towelette when a first wet towelette is removed from the roll core.

11. The cleaning roll of claim 1, wherein the roll core is substantially impermeable to moisture.

12. The cleaning roll of claim 1, further comprising a weight for orientating the cleaning roll such that the opening is accessible.

13. The cleaning roll of claim 2, wherein the void for receiving the rod of the standard sized bathroom tissue roll dispenser is off-center for orientating the bathroom tissue roll such that the opening is accessible.

14. The cleaning roll of claim 1, wherein the roll core made of disposable materials.

15. The cleaning roll of claim 1, wherein the roll core capable of being refilled.

16. The cleaning roll of claim 1, wherein the dry paper roll includes at least one of lotions, medications, perfume, vitamins and coloring.

17. The cleaning roll of claim 1, wherein the wet towelettes includes at least one of lotions, medications, perfume, vitamins and coloring.

* * * * *